US005881662A

United States Patent [19]

Bastian et al.

[11] Patent Number: 5,881,662

[45] Date of Patent: Mar. 16, 1999

[54] SEWING OR EMBROIDERING MACHINE

[75] Inventors: Eduard Bastian; Wilfried Halfmann, both of Kaiserslautern; Bernd Maue, Kreimbach-Kaulbach, all of Germany

[73] Assignee: G. M. Pfaff Aktiengesellschaft, Kaiserslautern, Germany

[21] Appl. No.: 48,535

[22] Filed: Mar. 25, 1998

[30] Foreign Application Priority Data

Mar. 26, 1997 [DE] Germany ..... 197 12 583.2

[51] Int. Cl.[6] ..... D05B 19/12

[52] U.S. Cl. ..... 112/470.04; 112/102.5; 112/277; 112/475.19; 364/470.09

[58] Field of Search ..... 112/470.04, 470.01, 112/275, 277, 475.01, 475.04, 102.5, 475.19, 470.06; 364/470.09

[56] References Cited

U.S. PATENT DOCUMENTS 5,050,513 9/1991 Frankel ..... 112/275 X 5,748,843 5/1998 Peck et al. ..... 112/470.04 X

*Primary Examiner*—Peter Nerbun

*Attorney, Agent, or Firm*—McGlew and Tuttle

[57] ABSTRACT

A sewing or embroidering machine with an electronic control device including a microcomputer. Access authorization for the individual modes of operation of the sewing and embroidering machine can be changed by the buyer of the machine. The assignment of access authorization to individual modes of operation of the sewing machine is stored in a first write-read memory in the form of a table, access authorization table. The first write-read memory is connected with the microprocessor and with a first input device such that after a corresponding operating function is called up or requested by a person authorized to do so, the access authorization can be correspondingly changed for the mode of operation in question by the input means.

9 Claims, 1 Drawing Sheet

SEWING OR EMBROIDERING MACHINE

FIELD OF THE INVENTION

The present invention pertains to a sewing or embroidering machine with an electronic control device containing a microcomputer.

BACKGROUND OF THE INVENTION

Industrial sewing machines and embroidering machines must be operated by sewing machine operators, plant mechanics and service personnel. Not all input and operating functions usually need to be accessible by the different persons. Certain functions were therefore made accessible to only certain persons, and distinctions can be made concerning authorized access between access via a code number, access via a key and free access.

The access of the different groups of persons to the different modes of operation of a machine is frequently set at the time of the shipping of a sewing machine. However, such a setting has the drawback that it does not take into account the greatly different work processes in different plants, because, e.g., the sewing machine operator is to use only the basic modes of operation in one plant, while the sewing machine operator shall also perform additional settings and programming of the machine in another plant.

A sewing machine with an electronic control device containing a microcomputer, in which the control device and consequently the microcomputer are connected to at least one input means for entering the actually desired mode of operation of the sewing machine (in the form of control codes), has already been known from DE 40 00 765 A1. The input means also includes, among other things, a keyboard.

A process and a device for checking the access authorization between a chip card and a terminal unit, in which a plurality of authorization codes are stored in corresponding memories in both the chip card and the terminal unit, have been known from DE 43 06 819 C2.

A relatively complicated process for determining the access authorization of the user of a computer of a networked computer system has been known from DE 44 43 339 A1. The user of the computer in question identifies himself by means of his computer against an identification server via his name, an identifier for the type of the access method (e.g., a password or a chip card) and a coded sequence of his personal data and a key for a coding process.

Furthermore, a locking system, in which data can be inductively transmitted between a code module and a lock module, has been known from DE 44 22 081 C2.

SUMMARY AND OBJECTS OF THE INVENTION

The basic object of the present invention is to design the sewing or embroidering machine of the type described in the introduction such that the access authorizations for the individual modes of operation can be changed by the buyer of the machine in a simple manner even later.

This object is accomplished according to the present invention by a sewing machine with input means for entering a plurality of different types of operations of the sewing machine and for entering access authorization data. A memory means is provided for associating a type of access code to each of the plurality of different types of operations. A control unit means controls operation of the sewing machine in response to the type of operation entered by the input means. The control unit includes microprocessor means for reading and writing to the memory means to change the type of access code associated with one of the plurality of different types of operations according to the access authorization data entered by the input means.

The present invention is based essentially on the idea of storing the assignment of the access authorization to the individual modes of operation of the machine in the form of a table (access authorization table) in a write-read memory. The write-read memory is connected with the microcomputer and input means such that after a corresponding operating function is prompted by a person authorized to do so, the access authorization can be correspondingly changed for the mode of operation in question by means of the input means.

Depending on the access authorization, the input means, via which the user in question of the sewing machine demonstrates his access authorization, may be a keyboard (e.g., for the manual input of an access code number) or a key switch.

In an advantageous embodiment of the present invention, a card slot for a chip card (card key) proved to be used as the key switch in an advantageous embodiment of the present invention. The access code number characterizing the access authorization is stored on a memory chip arranged on the card.

To make it possible to change the code numbers stored in a code number memory of the electronic control device in a simple manner, it proved, furthermore, to be advantageous to also use as the code number memory, a write-read memory which is connected to an input means (usually the keyboard) via the microcomputer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
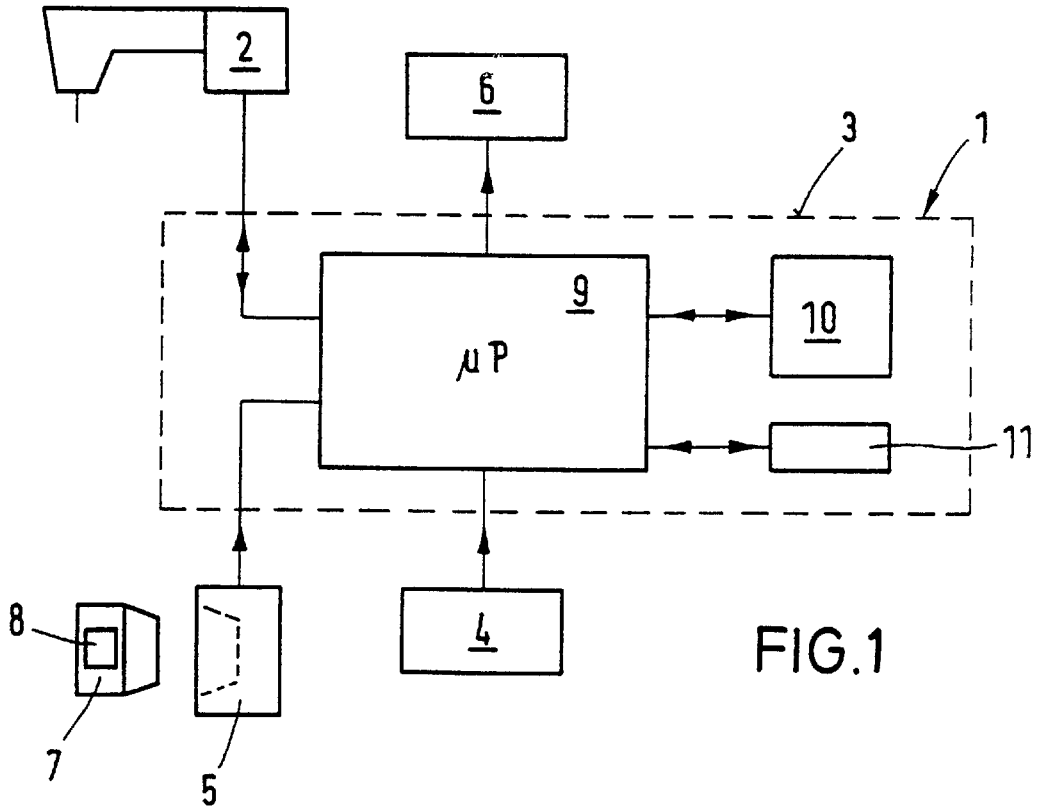
FIG. 1 is a block diagram of the present invention.

Referring to the drawings, and in particular to FIG. 1, reference number 1 designates a sewing machine, which comprises essentially a stitch-forming device part 2 and an electronic control device 3. The electronic control device 3 is connected to both a first input means 4 designed as a keyboard and a second input means 5 designed as a card slot and to a display unit 6. The chip card to be inserted into the card slot 5 is designated by 7, and the memory chip arranged on the card is designated by 8.

The electronic control device 3 comprises a microcomputer or microprocessor 9 as well as two write-read memories 10 and 11 connected to the microcomputer. The first write-read memory is used to store the access authorization table (assignment of the access authorization in question to the modes of operation of the sewing machine), and the second write-read memory is used as a code number memory.

Figure 2:
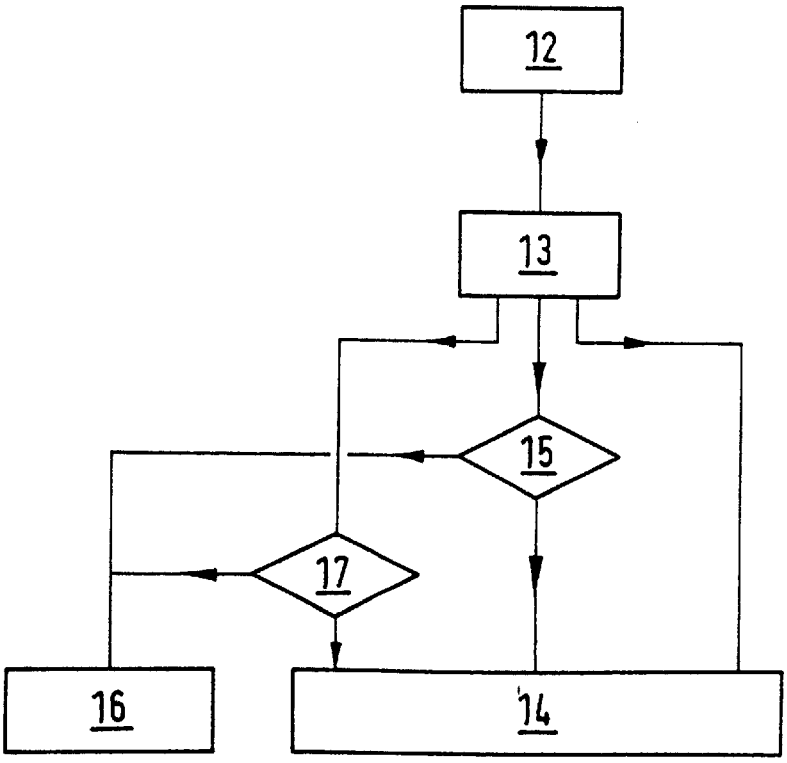
FIG. 2 is a flow chart to explain the mode of operation of the circuit shown in FIG. 1 during the checking of the access authorization.

The function of the sewing machine shown in FIG. 1 during the checking of the access authorization will be explained below on the basis of FIG. 2. The procedure to be followed during the setting of the access authorization will subsequently be explained:

Using the keyboard 4 shown in FIG. 1, the mode of operation, e.g. "sewing at maximum speed of rotation", is first entered by the user of the sewing machine 1. This process step is designated by 12 in FIG. 2. The microprocessor 9 of the electronic control device 3 then checks the type of access authorization needed for the mode of operation selected in the access authorization table stored in the write-read memory 10. This is process step 13 in FIG. 2. If there is free access, the corresponding mode of operation is carried out, process step 14.

However, if the access authorization is to be demonstrated by or requires an access code number, the control device 3 asks the user of the sewing machine 1 by a corresponding prompt on the display unit 6 to enter the code number. After entering the code number via the keyboard 4, the control device checks the code number against the number stored in the code memory, process step 15. If the two numbers agree, the corresponding mode of operation is carried out, process step 14. If the entered and stored code numbers are different, the error message, e.g. "Code not accepted", is displayed on the display unit 6, shown in FIG. 1 and process step 16 in FIG. 2.

If access authorization is to be demonstrated by means of, or requires, a card key 7, the control device 3 reads the code number stored on the chip memory 8 of the card 7 and compares it with the code number stored for this mode of operation in the code memory 11, process step 17. Depending on whether the code numbers agree or not, the mode of operation selected is again carried out, process step 14 or an error message is displayed process step 16.

If the type of access authorization set for a given mode of operation in the factory is to be changed for any reason, the person authorized to do so (whose access authorization also must be demonstrated by a code number or a key) selects the it function intended for the setting of the type of access authorization (e.g., "set access authorization") from a menu displayed on the display unit 6 (FIG. 1) by means of the keyboard 4. He/she then enters the code corresponding to the type of access authorization in question (e.g., 1—free access; 2—access by code number; 3—access by key, etc.) via the keyboard 4. The code stored in the write-read memory 10 for this mode of operation is overwritten as a result and the new code is used during the subsequent checking of the type of access authorization.

The present invention is, of course, not limited to the specifically described exemplary embodiment. Thus, the electronic control device may also be designed such that different code numbers are used for different modes of operation. The type of access authorization may also contain a multiple depression of the keys of the keyboard.

Furthermore, the code number stored in the code memory 11 may also be changed by means of the input means 4.

In addition, the write-read memories 10 and 11 may be the same memory in terms of hardware, in which different memory areas are intended for the access authorization table and the code numbers.

The features described in specification, drawings, abstract, and claims, can be used individually and in arbitrary combinations for practicing the present invention.

While specific embodiments of the invention have been shown and described in detail to illustrate the application of the principles of the invention, it will be understood that the invention may be embodied otherwise without departing from such principles.

APPENDIX

List of Reference Numbers

1 Sewing machine
2 Stitch-forming device part
3 Electronic control device
4 (First) input means, keyboard
5 (Second) input means, card slot, key switch
6 Display unit
7 Card key, chip card
8 Chip memory
9 Microcomputer
10 First write-read memory
11 Second write-read memory, code number memory
12–17 Process steps

What is claimed is:

1. A sewing machine comprising:

input means for entering a plurality of different types of operations of the sewing machine and for entering access authorization data;

a memory means for associating a type of access code to each of said plurality of different types of operations;

a control unit means for controlling operation of the sewing machine in response to said type of operation entered by said input means, said control unit including microprocessor means for reading and writing to said memory means to change said type of access code associated with one of said plurality of different types of operations according to said access authorization data entered by said input means.

2. A sewing machine in accordance with claim 1, wherein:

said input means is a keyboard.

3. A sewing machine in accordance with claim 1, further comprising:

another input means formed as a key switch and also entering access authorization data.

4. A sewing machine in accordance with claim 2, further comprising:

another input means formed as a key switch and also entering access authorization data.

5. A sewing machine in accordance with claim 3, wherein:

said key switch is a card slot for a chip card, said chip card includes a chip memory storing said access authorization data entered by said another input means, said access authorization data entered by said another input means is a code number.

6. A sewing machine in accordance with claim 1, further comprising:

another memory means for associating each of said different types of operations with an access code, said microprocessor reads and writes to said another memory means to change said access code associated with one of said plurality of different types of operations according to said access authorization data entered by said input means.

7. A sewing machine in accordance with claim 1, wherein:

a stitch-forming device part is provided and controlled by said microprocessor.

8. A sewing machine in accordance with claim 6, wherein:

a display is connected to said microprocessor;

said microprocessor requests a specific access code from an operator for each said operation entered by said input means, said specific access code being defined as associated by said another memory means with said operation, and being of a type as associated by said memory means with said operation, said microprocessor means blocking operation of the sewing machine if an access code entered does not compare with a content and type of said associated access code stored in said memory means and said another memory means.

9. A process for operating a sewing machine, the process comprising the steps of:

providing a plurality of input devices;

receiving a request for one of a plurality of operations of the sewing machine;

receiving a specific access code from said input devices;

comparing said received specific access code with an internal access code for said one of said plurality of operations;

comparing a type of said input device receiving the specific access code with a type of access code required for said one of said plurality of operations;

storing said type of access code in a memory means;

changing said type of an access code for an operation by one of said input devices.

* * * * *